US008938835B2

(12) United States Patent
Bae et al.

(10) Patent No.: US 8,938,835 B2
(45) Date of Patent: Jan. 27, 2015

(54) WASHING MACHINE AND METHOD OF CONTROLLING A WASHING MACHINE

(75) Inventors: Sun Cheol Bae, Changwon-si (KR); Kyung Hoon Kim, Changwon-si (KR); Han Su Jung, Changwon-si (KR); Jae Hyeok Choi, Changwon-si (KR); Ja In Koo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 241 days.

(21) Appl. No.: 12/466,495

(22) Filed: May 15, 2009

(65) Prior Publication Data

US 2009/0307851 A1 Dec. 17, 2009

(30) Foreign Application Priority Data

May 23, 2008 (KR) ..... 10-2008-0048182

(51) Int. Cl.
*D06F 35/00* (2006.01)

(52) U.S. Cl.
CPC ..... *D06F 35/006* (2013.01)
USPC ..... 8/159; 8/158

(58) Field of Classification Search
CPC ..... D06F 35/006
See application file for complete search history.

(56) References Cited

U.S. PATENT DOCUMENTS

| | | | | |
|---|---|---|---|---|
| 3,301,024 | A | 1/1967 | Smith | 68/12 |
| 4,782,544 | A | 11/1988 | Nystuen et al. | 8/159 |
| 5,207,764 | A | 5/1993 | Akabane et al. | |
| 5,671,494 | A | 9/1997 | Civanelli et al. | |
| 5,692,313 | A | 12/1997 | Ikeda et al. | 34/58 |
| 5,768,730 | A | 6/1998 | Matsumoto et al. | 8/159 |
| 5,887,456 | A | 3/1999 | Tanigawa et al. | 68/20 |
| 6,029,299 | A | 2/2000 | Baek et al. | 8/159 |
| 6,240,586 | B1 * | 6/2001 | Joo | 8/159 |
| 6,381,791 | B1 | 5/2002 | French et al. | 8/159 |
| 6,578,225 | B2 | 6/2003 | Jönsson | 8/159 |
| 7,412,740 | B2 | 8/2008 | Park et al. | 8/159 |
| 7,478,547 | B2 | 1/2009 | Okazaki et al. | 68/12.04 |
| 7,490,490 | B2 | 2/2009 | Hirasawa et al. | 68/12.04 |
| 7,530,133 | B2 | 5/2009 | Mitts | 8/159 |
| 7,627,920 | B2 | 12/2009 | Wong et al. | 8/159 |

(Continued)

FOREIGN PATENT DOCUMENTS

| | | |
|---|---|---|
| CA | 2 360 476 C | 5/2002 |
| CN | 1966812 | 5/2007 |

(Continued)

OTHER PUBLICATIONS

Korean Office Action dated Mar. 29, 2010.

(Continued)

*Primary Examiner* — Jason Ko
(74) *Attorney, Agent, or Firm* — KED & Associates LLP

(57) ABSTRACT

A washing machine and a method of controlling a washing machine are provided. The washing machine may include a drum in which laundry is provided and is rotated. The drum may operate at a first speed such that part of the laundry tumbles within the drum and another part of the laundry adheres to the drum. An unbalance amount or a first speed operation time of the drum, which is detected when the drum operates at the first speed, may be determined. When an abnormality occurs, rotation of the drum may stop or decelerate. Accordingly, at the time of a dehydration cycle, stability of the washing machine and laundry balancing can be ensured.

8 Claims, 10 Drawing Sheets

(56) References Cited

U.S. PATENT DOCUMENTS

| | | | | |
|---|---|---|---|---|
| 2001/0052265 | A1 | 12/2001 | French et al. | |
| 2002/0020196 | A1 | 2/2002 | Kakuda et al. | |
| 2003/0140427 | A1* | 7/2003 | Yamamoto et al. | 8/159 |
| 2005/0102766 | A1 | 5/2005 | Vande Haar et al. | 8/159 |
| 2005/0251926 | A1 | 11/2005 | Lee et al. | |
| 2005/0268670 | A1 | 12/2005 | Hirasawa et al. | 68/12.06 |
| 2006/0005319 | A1 | 1/2006 | Park | 8/158 |
| 2006/0107299 | A1 | 5/2006 | Bartfeld et al. | 75/110 |
| 2006/0185095 | A1 | 8/2006 | Mitts | 8/158 |
| 2006/0207299 | A1 | 9/2006 | Okazaki et al. | 68/12.02 |
| 2007/0050918 | A1* | 3/2007 | Kim et al. | 8/158 |
| 2008/0289118 | A1 | 11/2008 | Park et al. | 8/159 |

FOREIGN PATENT DOCUMENTS

| | | | |
|---|---|---|---|
| DE | 36 06 819 | A1 | 9/1987 |
| DE | 37 41 792 | A1 | 6/1989 |
| DE | 38 40 265 | A1 | 5/1990 |
| DE | 41 22 307 | A1 | 1/1993 |
| DE | 42 29 646 | A1 | 3/1994 |
| DE | 44 38 760 | A1 | 5/1996 |
| DE | 102 34 473 | A1 | 2/2004 |
| DE | 10 2006 017 530 | A1 | 10/2007 |
| EP | 0 071 308 | A2 | 2/1983 |
| EP | 0 302 319 | A1 | 2/1989 |
| EP | 0 763 618 | A2 | 3/1997 |
| EP | 0 807 706 | A2 | 11/1997 |
| EP | 1 516 952 | A2 | 3/2005 |
| EP | 1 538 251 | | 6/2005 |
| EP | 1 548 169 | A1 | 6/2005 |
| EP | 1 605 087 | A1 | 12/2005 |
| EP | 1 693 498 | A2 | 8/2006 |
| EP | 1 760 181 | | 3/2007 |
| EP | 2 128 323 | B1 | 12/2009 |
| GB | 2073257 | A | 10/1981 |
| GB | 2 322 141 | A | 8/1998 |
| GB | 2 327 502 | A | 1/1999 |
| JP | 64-40093 | | 2/1989 |
| JP | 01-268597 | A | 10/1989 |
| JP | 02-109593 | | 4/1990 |
| JP | 02-136173 | | 5/1990 |
| JP | 04-176494 | A | 6/1992 |
| JP | 05-31292 | A | 2/1993 |
| JP | 06-218181 | A | 8/1994 |
| JP | 08-299660 | A | 11/1996 |
| JP | 10-005485 | A | 1/1998 |
| JP | 10-127978 | A | 5/1998 |
| JP | 10-216391 | A | 8/1998 |
| JP | 11-216296 | A | 8/1999 |
| JP | 2000-157788 | A | 6/2000 |
| JP | 2001-224889 | A | 8/2001 |
| JP | 2005-199090 | A | 7/2005 |
| JP | 2008-054960 | A | 3/2008 |
| KR | 1994-0015033 | | 7/1994 |
| KR | 10-2000-0033342 | | 6/2000 |
| KR | 10-2001-0004704 | | 1/2001 |
| KR | 10-2004-0046049 | A | 6/2004 |
| KR | 10-2005-0012524 | | 2/2005 |
| KR | 10-2005-0042945 | | 5/2005 |
| KR | 10-2006-0049526 | | 5/2006 |
| WO | WO 00/28128 | A1 | 5/2000 |
| WO | WO 01/90473 | A1 | 11/2001 |
| WO | WO 2004/009899 | | 1/2004 |
| WO | WO 2005/106096 | | 11/2005 |
| WO | EP 1 995 366 | A1 | 11/2008 |

OTHER PUBLICATIONS

European Search Report dated Sep. 9, 2009 for Application No. 09160861.2-2314.

Korean Office Action dated Mar. 16, 2010 for Application 10-2008-0048185.

Korean Office Action dated Mar. 16, 2010 for Application 10-2008-0048186.

Korean Office Action dated Mar. 30, 2010 for Application 10-2008-0048183.

European Search Report dated Aug. 6, 2009.

Chinese Office Action for Application No. 200910141732.1 dated Aug. 19, 2010 and English translation.

Chinese Office Action dated Oct. 20, 2010 issued in Application No. 200910141728.6.

Canadian Office Action dated May 30, 2011 issued in Application No. 2,666,777.

Canadian Office Action dated May 30, 2011 issued in Application No. 2,666,779.

United States Office Action dated Aug. 23, 2011 issued in U.S. Appl. No. 12/470,804.

United States Office Action dated Aug. 23, 2011 issued in U.S. Appl. No. 12/470,818.

United States Office Action dated Aug. 24, 2011 issued in U.S. Appl. No. 12/470,800.

United States Office Action dated Aug. 24, 2011 issued in U.S. Appl. No. 12/470,815.

U.S. Office Action issued in U.S. Appl. No. 12/470,800 dated Mar. 6, 2012.

U.S. Office Action issued in U.S. Appl. No. 12/470,815 dated Mar. 12, 2012.

U.S. Office Action issued in U.S. Appl. No. 12/466,513 dated Apr. 5, 2012.

U.S. Office Action issued in U.S Appl. No. 12/470,800 dated Jun. 27, 2012.

European Notice of Opposition dated Aug. 1, 2012 issued in Application No. 09160863.8.

European Notice of Opposition dated Aug. 30, 2012 issued in Application No. 09160863.8.

Notice of Allowance dated Nov. 7, 2013 for co-pending U.S. Appl. No. 12/466,513.

* cited by examiner

WASHING MACHINE AND METHOD OF CONTROLLING A WASHING MACHINE

This application claims priority from Korean Patent Application No. 10-2008-0048182, filed May 23, 2008, the subject matter of which is hereby incorporated herein by reference.

BACKGROUND

1. Field

Embodiments of the present invention may relate to a washing machine and a method of controlling a washing machine. More particularly, embodiments of the present invention may relate to a washing machine and a method thereof having improved stability and improved laundry balancing at a time of a dehydration cycle.

2. Background

A drum-type washing machine may perform washing by employing a drum that rotates by a driving force of a motor and frictional force of laundry in a state in which a detergent, wash water, and the laundry are input to the drum. The drum-type washing machine may rarely damage the laundry, may rarely entangle the laundry, and may have knocking and rubbing washing effects.

After wash and rinse cycles are finished, a dehydration cycle may be performed. In order to perform the dehydration cycle, laundry is distributed effectively. A variety of methods have been used to distribute the laundry. For example, a method may be used to determine an unbalance amount in a state in which laundry adheres to the drum. However, this method may be disadvantageous in that it has a long balancing time of laundry and the state of the laundry may be decided by sensing an unbalance amount of the laundry in the state in which the laundry adheres to the drum. Further, when laundry is unbalanced with the laundry adhering to the drum, it may become problematic in stability of a washing machine.

BRIEF DESCRIPTION OF THE DRAWINGS

Objects and features of arrangements and embodiments of the present invention may become apparent from the following description taken in conjunction with the accompanying drawings, in which like reference numerals refer to like elements and wherein.

DETAILED DESCRIPTION

Arrangements and embodiments of the present invention may be described in detail with reference to the accompanying drawings so that they can be readily implemented by those skilled in the art.

Figure 1:
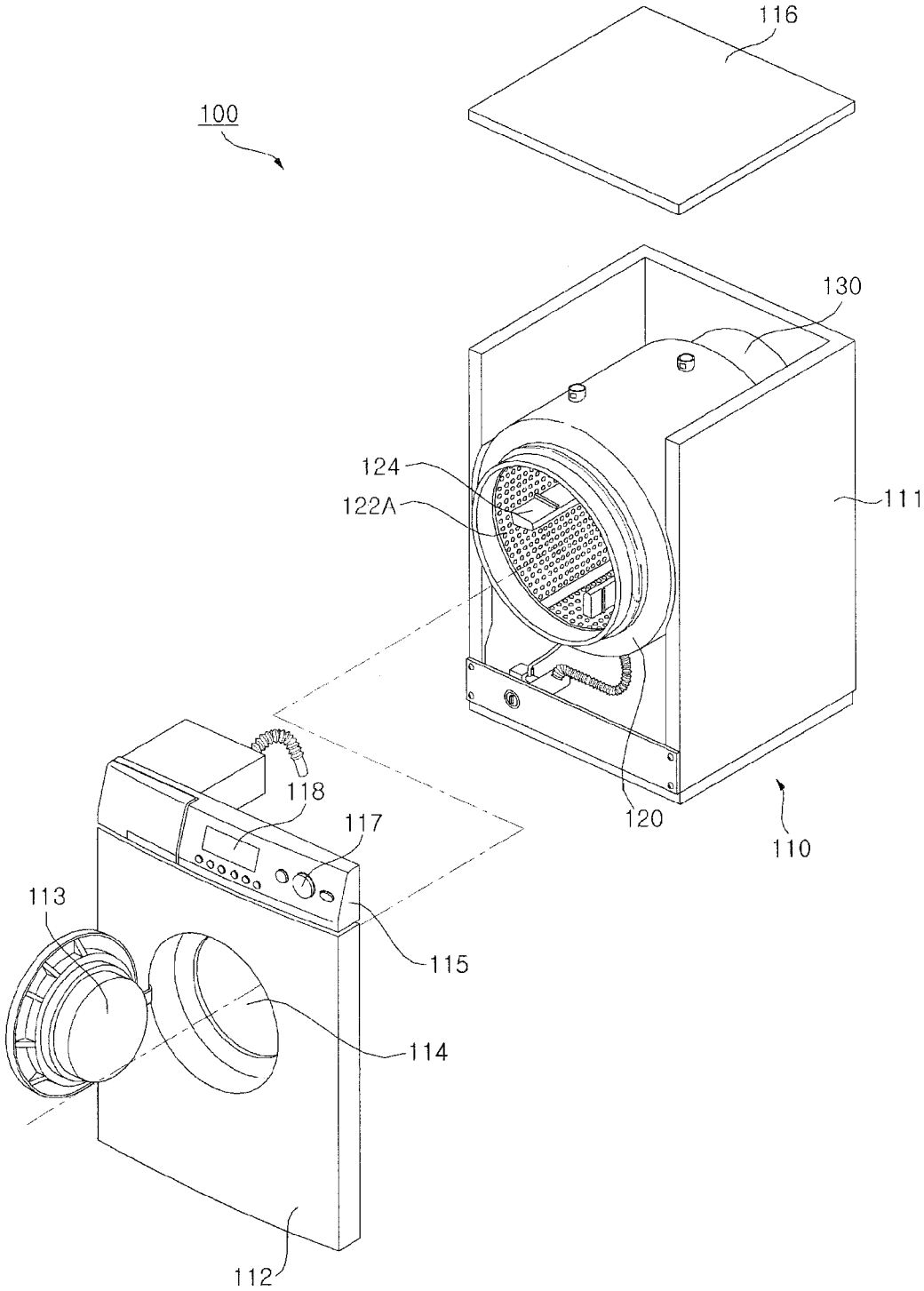
FIG. 1 is a perspective view showing a washing machine in accordance with an example embodiment of the present invention.

FIG. 1 is a perspective view showing a washing machine in accordance with an example embodiment of the present invention. Other embodiments and configurations are also within the scope of the present invention.

More specifically, FIG. 1 shows a washing machine 100 that includes a cabinet 110 forming an external shape of the washing machine 100, a tub 120 disposed within the cabinet 110 and supported by the cabinet 110, a drum 122 disposed within the tub 120 in which laundry is washed, a motor 130 for driving the drum 122, a wash water supply apparatus (not shown) disposed outside a cabinet main body 111 and configured to supply wash water to the cabinet 110, and a drain apparatus (not shown) formed under the tub 120 and configured to drain wash water to outside.

The drum 122 may include a plurality of through-holes 122A for having wash water pass therethrough. Lifters 124 may be disposed within the drum 122 so that laundry may be raised up to a specific height when the drum 122 is rotated and may then be dropped because of gravity.

The cabinet 110 may include the cabinet main body 111, a cabinet cover 112 disposed on a front side of the cabinet main body 111 and coupled thereto, a control panel 115 disposed on an upper side of the cabinet cover 112 and coupled to the cabinet main body 111, and a top plate 116 disposed at the top of the control panel 115 and coupled to the cabinet main body 111.

The cabinet cover 112 may include a laundry inlet/outlet hole 114 formed to have laundry pass therethrough, and a door 113 disposed rotatably left and right so that the laundry inlet/outlet hole 114 may be opened and closed.

The control panel 115 may include a control button 117 for manipulating operating states of the washing machine 100, and a display device 118 disposed on one side of the control button 117 and configured to display operating states of the washing machine 100.

The control button 117 and the display device 118 within the control panel 115 may be electrically connected to a controller (not shown). The controller (not shown) may electrically control respective constituent elements, etc. of the washing machine 100. Operation of the controller (not shown) will be described below.

Figure 2:
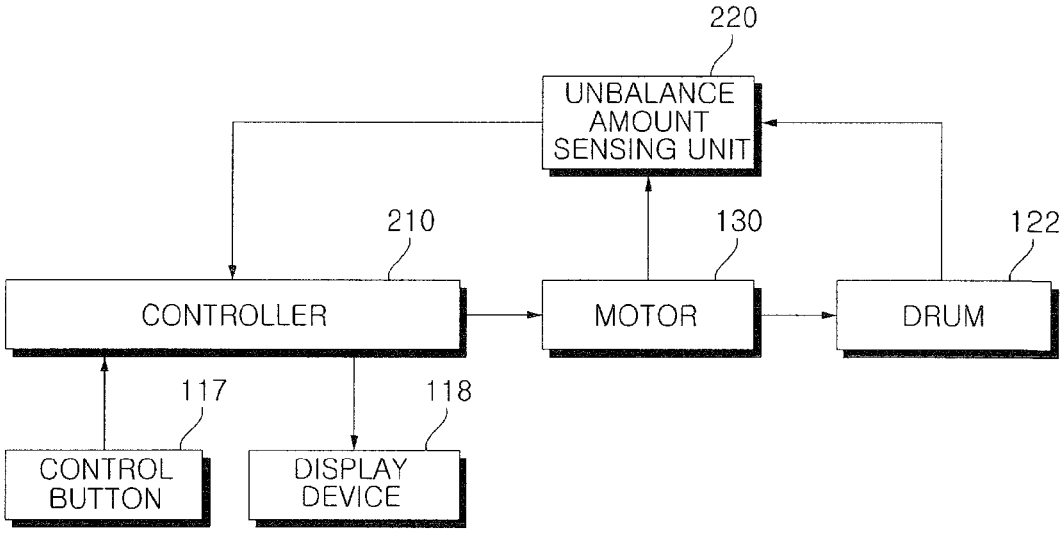
FIG. 2 is an internal block diagram of the washing machine shown in FIG. 1.

FIG. 2 is an internal block diagram of the washing machine shown in FIG. 1. Other embodiments and configurations are also within the scope of the present invention.

FIG. 2 shows a controller 210 that may operate in response to an operation signal received from the control button 117. Actual washing, rinse, and dehydration cycles may be performed. For the actual washing, rinse, and dehydration cycles, the controller 210 may control the motor 130. Although not shown, an inverter (not shown) may be used to control the motor 130. For example, when the controller 210 outputs a pulse width modulated (PWM) switching control signal to the inverter (not shown), the inverter (not shown)

may perform a high-speed switching operation in order to supply an AC power of a specific frequency to the motor 130.

The controller 210 may display operating states of the washing machine 100 through the display device 118. For example, the controller 210 may display operating states, such as actual washing, rinse, and dehydration cycles, through the display device 118.

The motor 130 may drive the drum 122. The drum 122 may be disposed within the tub 120, as shown in FIG. 1, and may allow for laundry to be input for washing. The drum 122 may be rotated by the motor 130.

An unbalance amount sensing unit 220 may sense an unbalance amount of the drum 122 (i.e., an unbalance (UB) of the drum 122). The unbalance amount may be sensed based on rotation speed variation of the drum 122 (i.e., a rotation speed variation of the motor 130). A speed sensor (not shown) may sense a rotation speed of the motor 130. A rotation speed of the motor 130 may be calculated based on an output current value flowing through the motor 130, and an unbalance amount may be sensed based on the rotation speed. As such, the motor 130 may include a current sensor (not shown) such as an encoder.

Although the unbalance amount sensing unit 220 is shown as being provided separately from the controller 210, embodiments of the present invention are not limited to this configuration. For example, the unbalance amount sensing unit 220 may be included within the controller 210. In such an example, a rotation speed and an output current value of the motor 130, which are respectively sensed by the speed sensor (not shown) and the current sensor (not shown), may be input to the controller 210.

Although not shown, a laundry amount sensor (not shown) may also be included. The laundry amount sensor (not shown) may provide an indication of an amount of load of sensed laundry to the controller 210.

Figure 3:
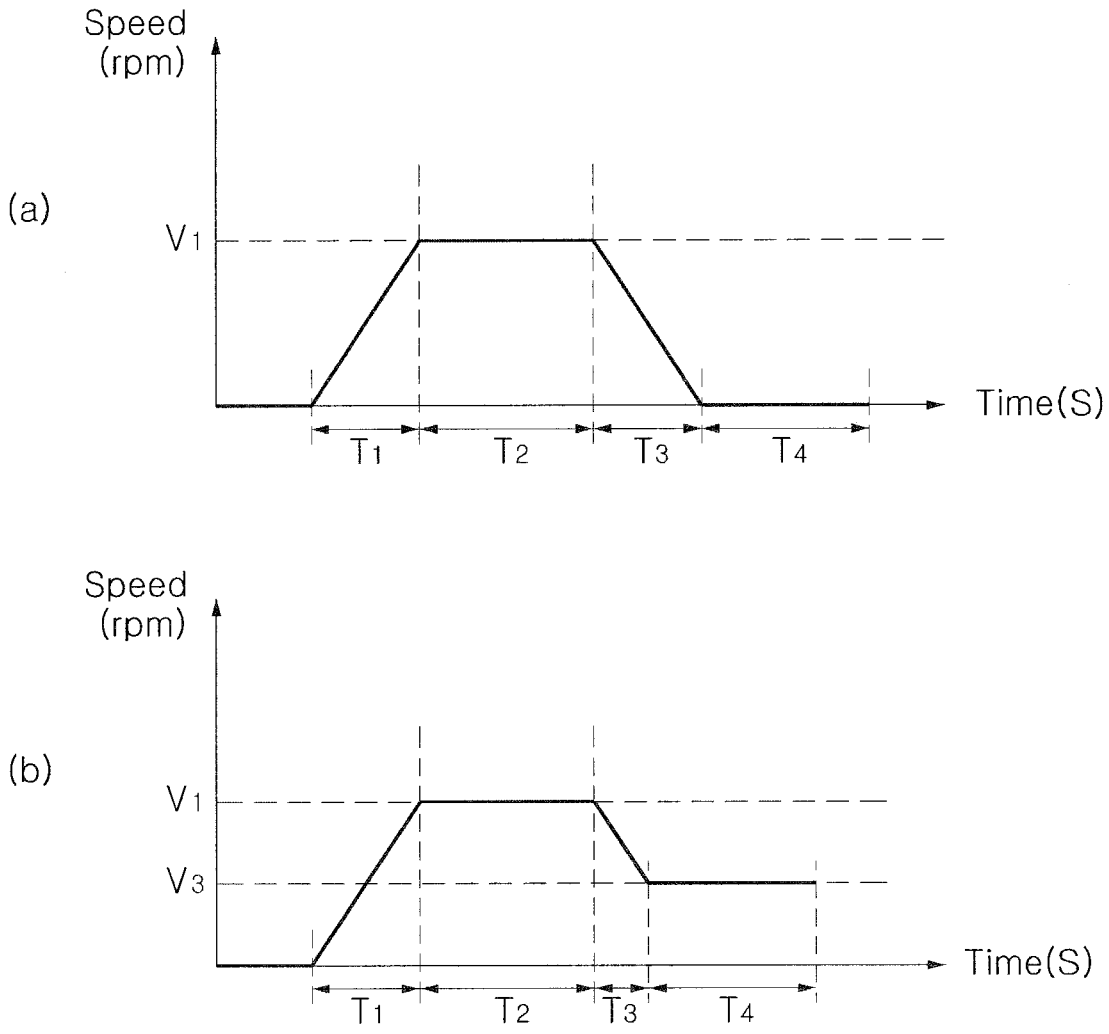
FIGS. 3(*a*)-3(*b*) are graphs showing relationships between time and a rotation speed of a drum within the washing machine of FIG. 1.

FIGS. 3(*a*)-3(*b*) are graphs showing relationships between time and a rotation speed of a drum within the washing machine of FIG. 1. Other graphs and embodiments are also within the scope of the present invention.

Figure 5:
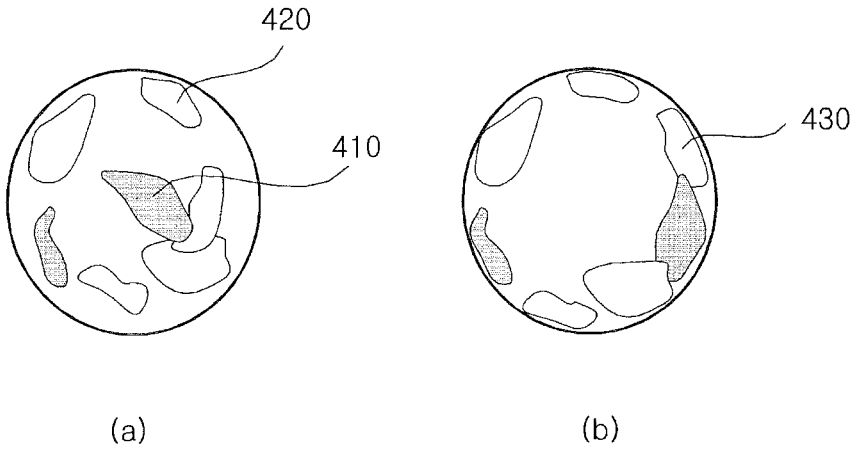
FIGS. 5(*a*)-5(*b*) are diagrams showing states of laundry within a drum according to a first speed and a second speed.

A speed of the drum 122 may increase to a first speed V1 during a first period T1 as shown in FIG. 3(*a*). The first speed V1 may be a speed at which part 410 of the laundry tumbles within the drum 122 and another part 420 of the laundry adheres to the drum 122, as shown in FIG. 5(*a*). For example, the first speed V1 may be a speed at which 20% to 30% of a total amount of laundry tumbles within the drum 122 and 70% to 80% of the total amount of the laundry adheres to the drum 122.

During a second period T2 as shown in FIG. 3(*a*), the drum 122 may operate or rotate at the first speed V1. When an unbalance amount sensed by the unbalance amount sensing unit 220 is a first specific value or greater while the drum 122 operates at the first speed V1 (i.e., if the operation is determined to be abnormal), then rotation of the drum 122 may stop or decelerate.

FIG. 3(*a*) shows an example where the drum 122 stops and FIG. 3(*b*) shows an example where the drum 122 decelerates and operates or rotates at a third speed V3. When the drum 122 stops as shown in FIG. 3(*a*), the speed of the drum 122 decelerates during a third period T3 and stops during a fourth period T4. On the other hand, when the speed of the drum 122 decelerates to the third speed V3 as shown in FIG. 3(*b*), the speed of the drum 122 decelerates during the third period T3 and operates at the third speed V3 during the fourth period T4.

As described above, an unbalance amount of the drum may be determined while the drum 122 rotates at the first speed V1. When an abnormality occurs, rotation of the drum 122 may stop or decelerate. Accordingly, stability of the washing machine 100 and balancing of laundry may be ensured at a time of the dehydration cycle.

Figure 4:
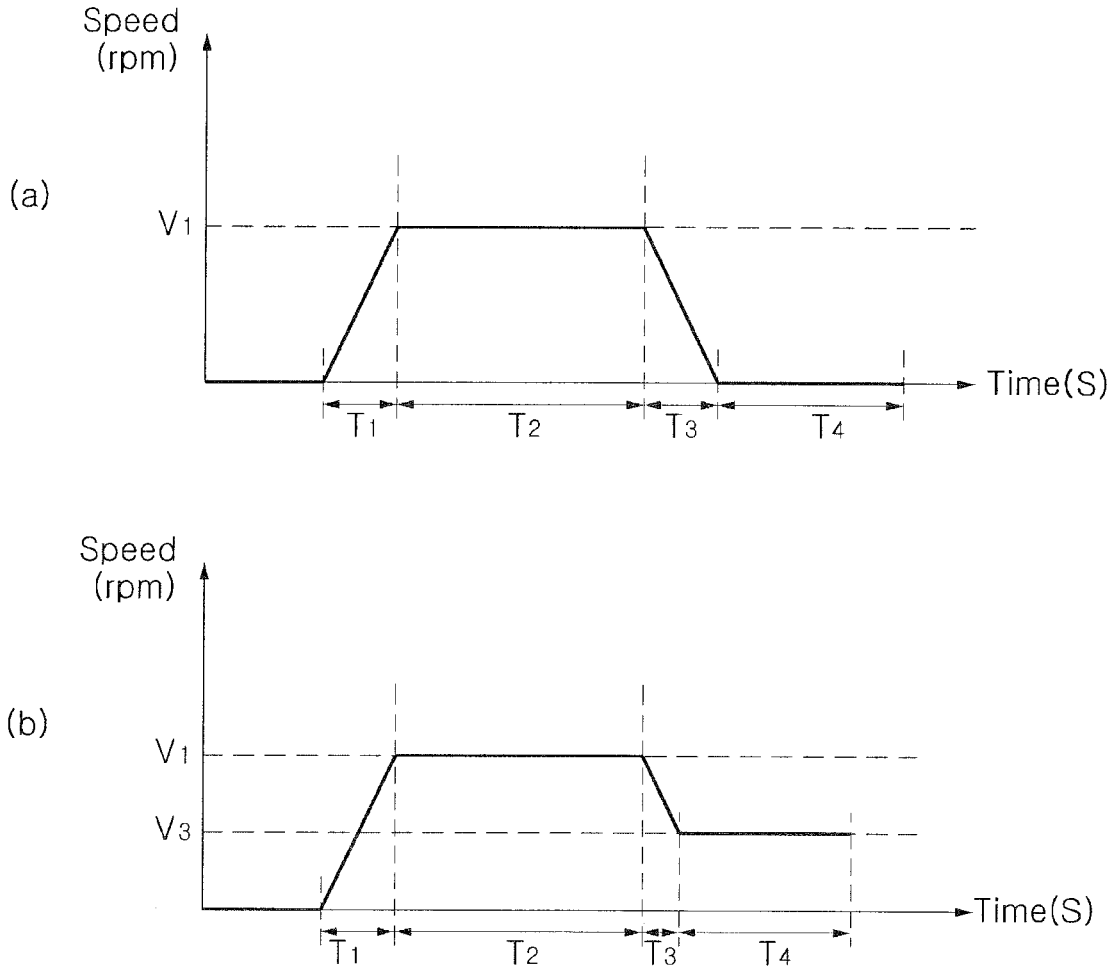
FIGS. 4(*a*)-4(*b*) are graphs showing relationships between time and a rotation speed of a drum within the washing machine of FIG. 1.

FIGS. 4(*a*)-4(*b*) are graphs showing relationships between time and a rotation speed of the drum within the washing machine of FIG. 1. Other graphs and embodiments are also within the scope of the present invention.

The graphs of FIGS. 4(*a*)-4(*b*) are similar to FIGS. 3(*a*)-3(*b*), but differ in that a a period of operation of the first speed is a specific time or greater. Stated differently, FIGS. 4(*a*)-4(*b*) differ from FIGS. 3(*a*)-3(*b*) in that the drum 122 is not stopped or decelerated when an unbalance amount at the time of a first speed operation is a first specific value or greater, as shown in FIG. 3, but rather the drum 122 is stopped or decelerated when a time period of the first speed (i.e., a first speed operation) is a specific time or greater.

FIG. 4(*a*) shows an example where the drum 122 stops, and FIG. 4(*b*) shows an example where the drum 122 decelerates and operates at the third speed V3.

As described above, when an abnormality occurs while an operating time of the drum 122 is determined during the first speed V1 operation, rotation of the drum 122 stops or is decelerated. Accordingly, stability of the washing machine 100 and balancing of laundry can be ensured at a time of a dehydration cycle.

FIGS. 5(*a*)-5(*b*) are diagrams showing states of laundry within a drum according to a first speed and a second speed. Other states and/or diagrams may also be within the scope of the present invention.

The first speed V1 is a speed at which the part 410 of laundry tumbles within the drum 122 and the other part 420 of the laundry adheres to the drum 122, as shown in FIG. 5(*a*). For example, the first speed V1 may be a speed at which 20% to 30% of a total amount of laundry tumbles within the drum 122 and 70% to 80% of the total amount of the laundry adheres to the drum 122.

The second speed V2 is a speed at which the entire laundry 430 adheres to the drum 122, as shown in FIG. 5(*b*).

Figure 6:
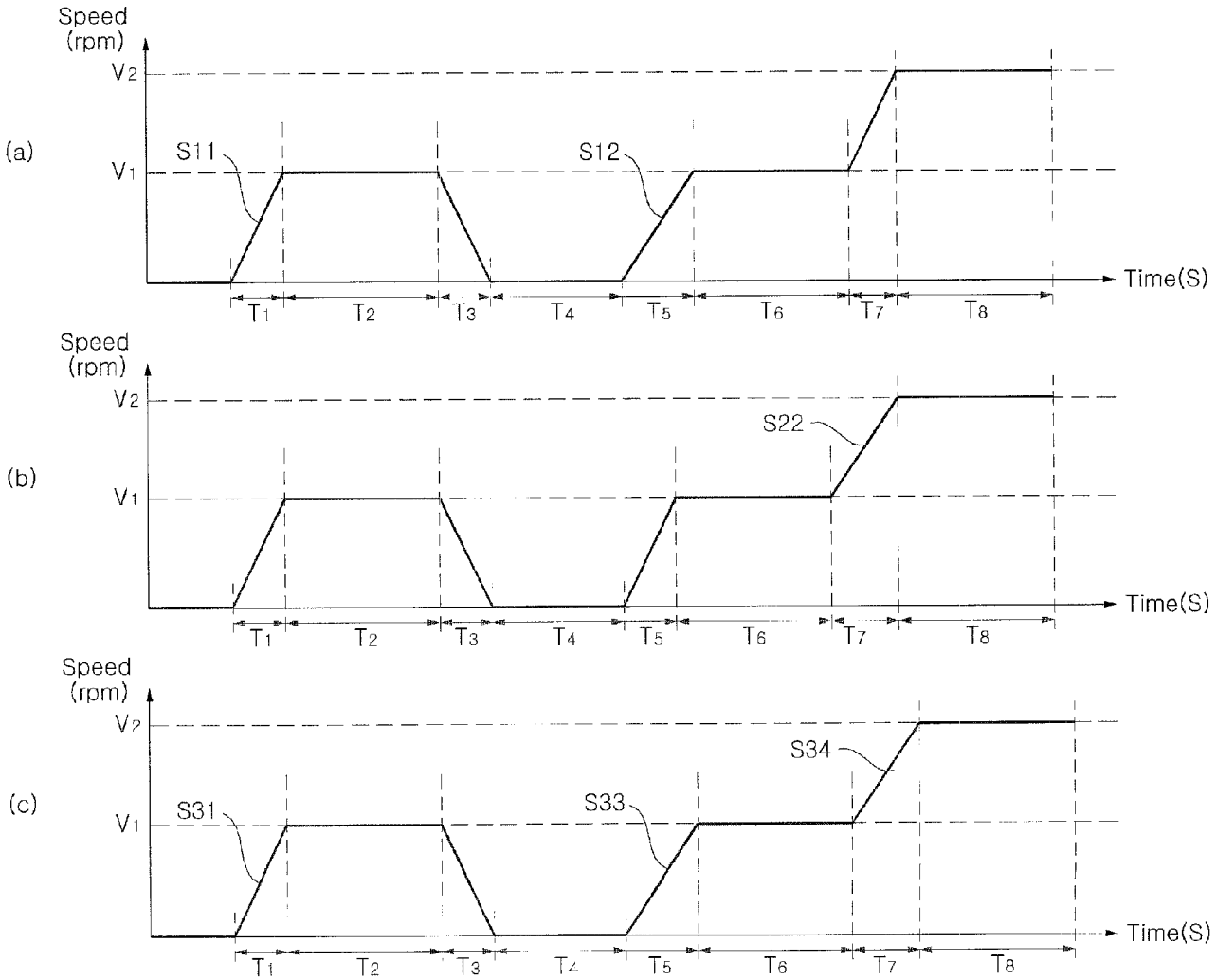
FIGS. 6(*a*)-6(*c*) are graphs showing relationships between time and a rotation speed of a drum within the washing machine of FIG. 1.

FIGS. 6(*a*)-6(*c*) are graphs showing relationships between time and a rotation speed of a drum within the washing machine of FIG. 1. Other graphs and embodiments are also within the scope of the present invention.

The graphs of FIGS. 6(*a*) to 6(*c*) are almost similar to FIG. 3(*a*). For example, in a manner similar to FIG. 3(*a*) the speed of the drum 122 may increase to a first speed V1 during the first period T1, operate at the first speed V1 during the second period T2, decelerate toward a stopped speed during the third period T3, and then stop during the fourth period T4.

When the drum 122 operates again after being stopped, a speed of the drum 122 may increase to the first speed V1 again during a fifth period T5 and may then operate at the first speed V1 during a sixth period T6. While the drum 122 is operating at the first speed V1, if an unbalance amount sensed by the unbalance amount sensing unit 220 is less than a second specific value (i.e., the drum has been stabilized), then the speed of the drum 122 may increase to the second speed V2. The second speed V2 may be a speed at which the entire laundry 430 adheres to the drum 122, as shown in FIG. 5(*b*).

During a seventh period T7, the speed of the drum 122 may increase toward the second speed V2 at a specific slope. When the drum 122 increases to the second speed V2, if a sensed unbalance amount of the drum 122 is not a third specific value or greater (i.e., the drum has been stabilized), then the drum 122 operates at the second speed V2 during an eighth period T8.

When the drum operates or rotates again after the fifth period T5, at least one of a rising slope of speed toward the first speed V1 and a rising slope of speed toward the second speed V2 may change. This may improve stability of the washing machine 100 and a balancing state of laundry, considering that an abnormality may occur when the drum 122 operates at the first speed V1 and a sensed unbalance amount is the first specific value or greater.

The rising slope of speed toward the first speed V1 and the rising slope of speed toward the second speed V2 may change within a specific range. For example, when the drum 122 operates or rotates again, the rising slope of speed toward the first speed V1 and the rising slope of speed toward the second speed V2 may be made gentle to improve stability of the washing machine and balancing of laundry. However, embodiments of the present invention are not limited to the above example. For example, the rising slope of speed toward the first speed V1 and/or the second speed V2 may be abrupt within a specific range.

When the drum 122 operates or rotates again after the fifth period T5, the drum 122 may operate or rotate in a reverse direction. In other words, in the example in which the drum 122 rotates in a first direction during the first to third periods T1 to T3, the drum 122 may rotates in a second direction, opposite to the first direction, when the drum 122 rotates again after the fifth period T5.

FIG. 6(*a*) shows an example where first speed rising slopes S11 and S12 change before and after the drum operates or rotates again. FIG. 6(*b*) shows an example where a second speed rising slope S22 changes after the drum 122 operates or rotates again. FIG. 6(*c*) shows an example where first speed rising slopes S31 and S33 change before and after the drum 122 operates or rotates again and an example where a second speed rising slope S34 changes after the drum 122 operates or rotates again.

Although not shown, at least one water drain process, operated at a resonant speed or less to remove moisture contained in laundry, may be performed after the second speed V2 at which the entire laundry adheres to the drum 122. After the water drain process is completed, an actual dehydration process may be performed in which the drum 122 operates at a maximum speed.

Relationships between time and the rotation speed of the drum 122 within the washing machine, as shown in FIGS. 3, 4 and 6 may be established based on operating states of the controller 210. That is, the controller 210 may control an operating speed, an operating time, etc. of the drum 122 in consideration of an unbalance amount of the drum 122, an operation command, the laundry amount, the type of laundry, etc.

As described above, when the drum 122 operates at the first speed V1, an unbalance amount or an operating time of the drum 122 may be determined. When an abnormality occurs, rotation of the drum 122 may stop or decelerate immediately. Accordingly, at the time of the dehydration cycle, stability of the washing machine 100 and balancing of laundry may be ensured. Further, when the drum 122 operates or rotates again, at least one of the rising slope of speed toward the first speed V1 and the rising slope of speed toward the second speed V2 may change, thereby improving stability of the washing machine and balancing of laundry.

In order to distribute laundry accurately and rapidly, the drum 122 may be driven at the first speed V1 at which part of the laundry tumbles, and not at a speed at which the entire laundry tumbles as in disadvantageous arrangements, thus meeting a balancing state of the laundry to some extent. The drum 122 may then operate at the second speed V2.

The first speed V1 may be approximately 60 rpm, the second speed V2 may be approximately 108 rpm, and the third speed V3 may be approximately 30 rpm. Other speeds are also within the scope of the present invention.

Figure 7:
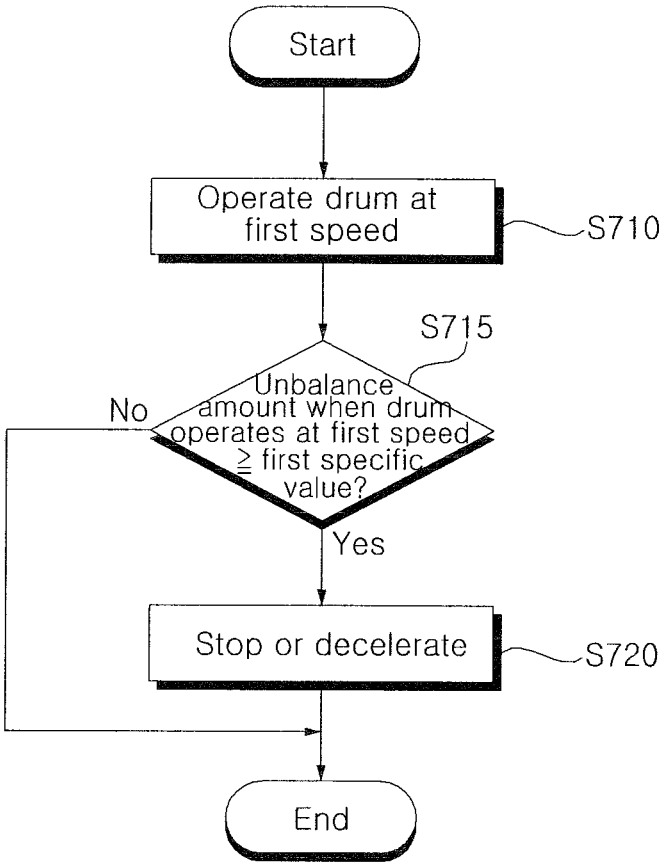
FIG. 7 is a flowchart illustrating a method of controlling a washing machine in accordance with an example embodiment of the present invention.

FIG. 7 is a flowchart illustrating a method of controlling a washing machine in accordance with an example embodiment of the present invention. Other operations, orders of operations and embodiments are also within the scope of the present invention.

The controller 210 may control the drum 122 to rotate at the first speed V1 in operation S710. As shown in FIG. 3(*a*), the speed of the drum 122 may increase up to the first speed V1 and the drum 122 may then operate (or rotate) at the first speed V1. The first speed V1 may be a speed at which part of laundry tumbles within the drum 122 and another part of the laundry adheres to the drum 122. For example, the first speed V1 may be a speed at which 20% to 30% of a total amount of laundry tumbles within the drum and 70% to 80% of the total amount of the laundry adheres to the drum 122.

The controller 210 may then determine whether an unbalance amount during operation at the first speed V1 is a first specific value or greater in operation S715. If the unbalance amount during operation at the first speed V1 is determined to be the first specific value or greater, the controller 210 may stop or decelerate the drum 122 in operation S720. FIG. 3(*a*) shows an example where the drum 122 is stopped, and FIG. 3(*b*) shows an example where the drum 122 is decelerated and then operated at the third speed V3.

Figure 8:
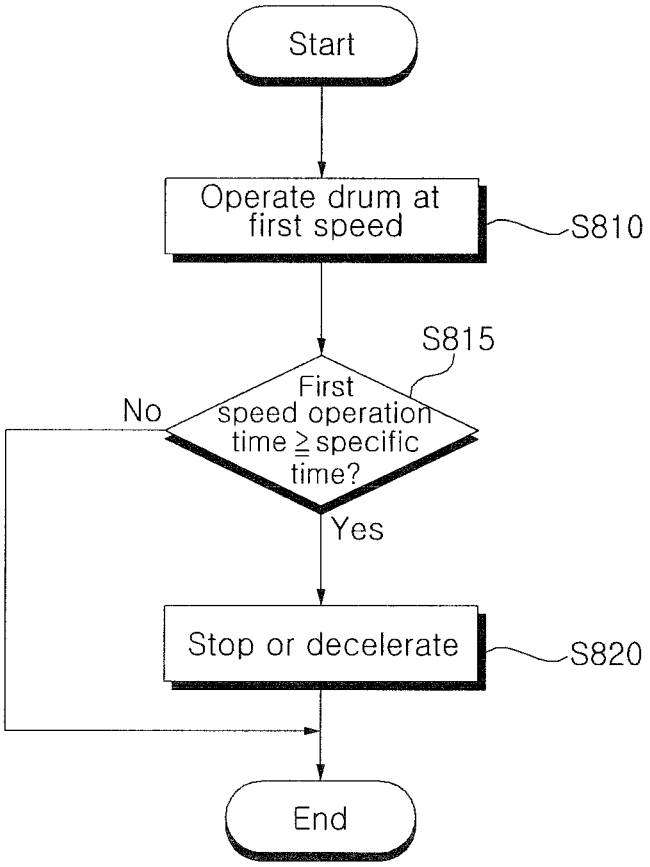
FIG. 8 is a flowchart illustrating a method of controlling a washing machine in accordance with an example embodiment of the present invention.

FIG. 8 is a flowchart illustrating a method of controlling a washing machine in accordance with an example embodiment of the present invention. Other operations, orders of operations and embodiments are also within the scope of the present invention.

The control method shown in FIG. 8 may be similar to the method shown in FIG. 7, but differs in that a determination is made whether an operating time at the first speed is abnormal.

The controller 210 may control the drum 122 to operate at the first speed V1 in operation S810.

The controller 210 may then determine whether an operating time at the first speed V1 is a specific time or greater in operation S815. If the operating time at the first speed V1 is determined to be the specific time or greater, the controller 210 may stop or decelerate the drum 122 in operation S820. FIG. 4(*a*) shows an example in which the drum 122 is stopped. FIG. 4(*b*) shows an example in which the drum 122 is decelerated and the drum 122 then operates at the third speed V3.

Figure 9:
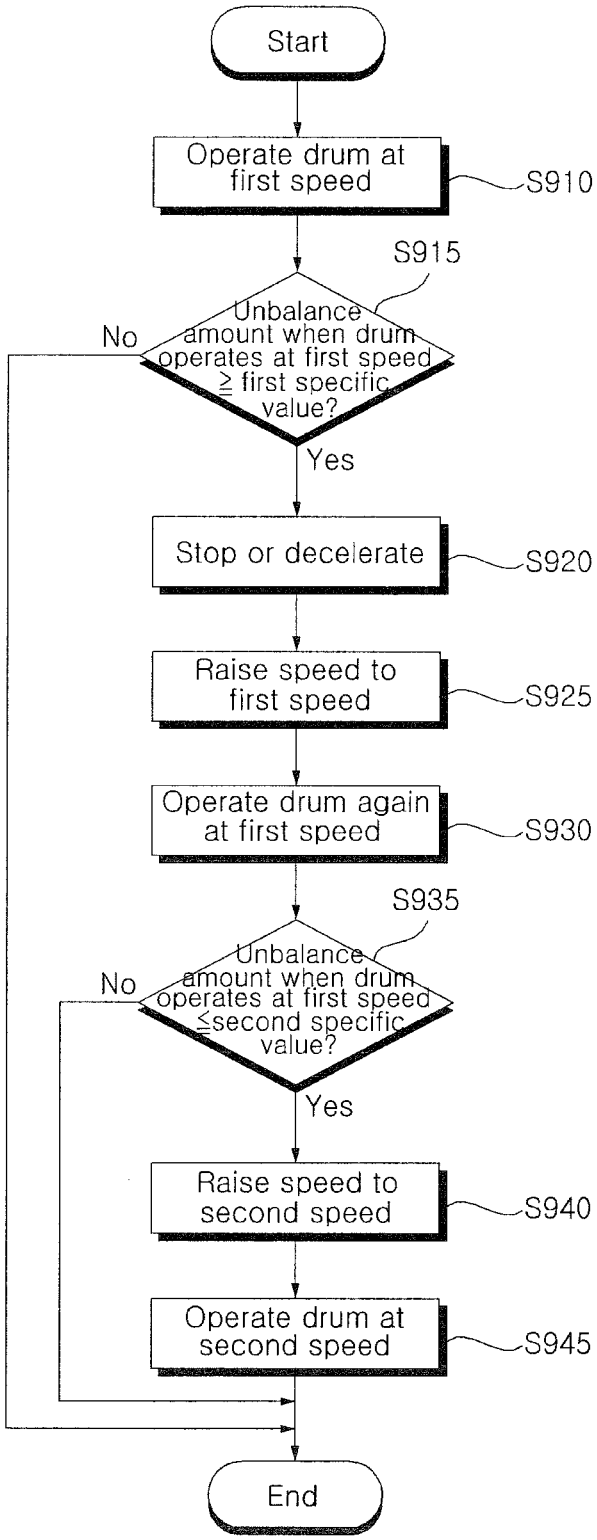
FIG. 9 is a flowchart illustrating a method of controlling a washing machine in accordance with an example embodiment of the present invention.

FIG. 9 is a flowchart illustrating a method of controlling a washing machine in accordance with an example embodiment of the present invention. Other operations, orders of operations and embodiments are also within the scope of the present invention.

The method of controlling the washing machine shown in FIG. 9 may be similar to the method shown in FIG. 7. That is, the first speed operation S910, the operation S915 and the stop or deceleration operation S920 may be the same or similar as shown in FIG. 7. Thus, a description thereof is omitted for ease of discussion.

After the stop or deceleration operation S920, the controller 210 may increase the speed of the drum 122 to the first speed V1 in operation S925. The rising slope of speed toward the first speed V1 can be changed in order to improve balancing of laundry.

The controller 210 may then operate or rotate the drum 122 at the first speed V1 in operation S930.

The controller 210 may determine whether an unbalance amount during the operation at the first speed V1 is a second specific value or less in operation S935.

If the unbalance amount during operation at the first speed V1 is determined to be the second specific value or less, the controller 210 may increase the speed of the drum 122 to a second speed V2 in operation S940. The rising slope of speed toward the second speed V2 may be changed to improve balancing of laundry.

The controller 210 may then operate the drum 122 at the second speed V2 in operation S945.

Although not shown, before the second speed operation S945, a determination may be made whether an unbalance amount of the drum 122 is a third specific value or greater when the speed of the drum 122 increases to the second speed V2. If the unbalance amount is determined to be the third specific value or greater, the controller 210 may control the drum 122 to stop or decelerate the drum 122 in operation S920. However, if the unbalance amount of the drum 122 is determined to not be the third specific value, the controller 210 may control the drum 122 to operate at the second speed in operation S945.

When the drum 122 operates again after the stop or deceleration operation S920, the drum 122 can be driven or rotated in a reverse direction. In other words, in the example in which the drum 122 operates in a first direction during the first speed operation S910 to the stop or deceleration operation S920, the drum 122 may be driven or rotated in a second direction, opposite to the first direction, when the drum 122 operates or rotates again after the first speed rising operation S925.

As described above, when the drum operates or rotates at the first speed V1, an unbalance amount of the drum may be determined, and when an abnormality occurs, rotation of the drum 122 may stop or decelerate immediately. Accordingly, at the time of the dehydration cycle, stability of the washing machine and balancing of laundry can be ensured. Further, when the drum 122 operates again, at least one of a first speed rising slope and a second speed rising slope can be changed, thereby improving stability of the washing machine and balancing of laundry.

In order to distribute laundry accurately and rapidly, the drum 122 may be driven at the first speed V1 at which part of the laundry tumbles, which is not at a speed at which the entire laundry tumbles as in disadvantageous arrangements, thus meeting a balancing state of the laundry to some extent. The drum 122 may then operate at the second speed V2.

The first speed V1 may be approximately 60 rpm, the second speed V2 may be approximately 108 rpm, and the third speed V3 may be approximately 30 rpm. Other speeds are also within the scope of the present invention.

Figure 10:
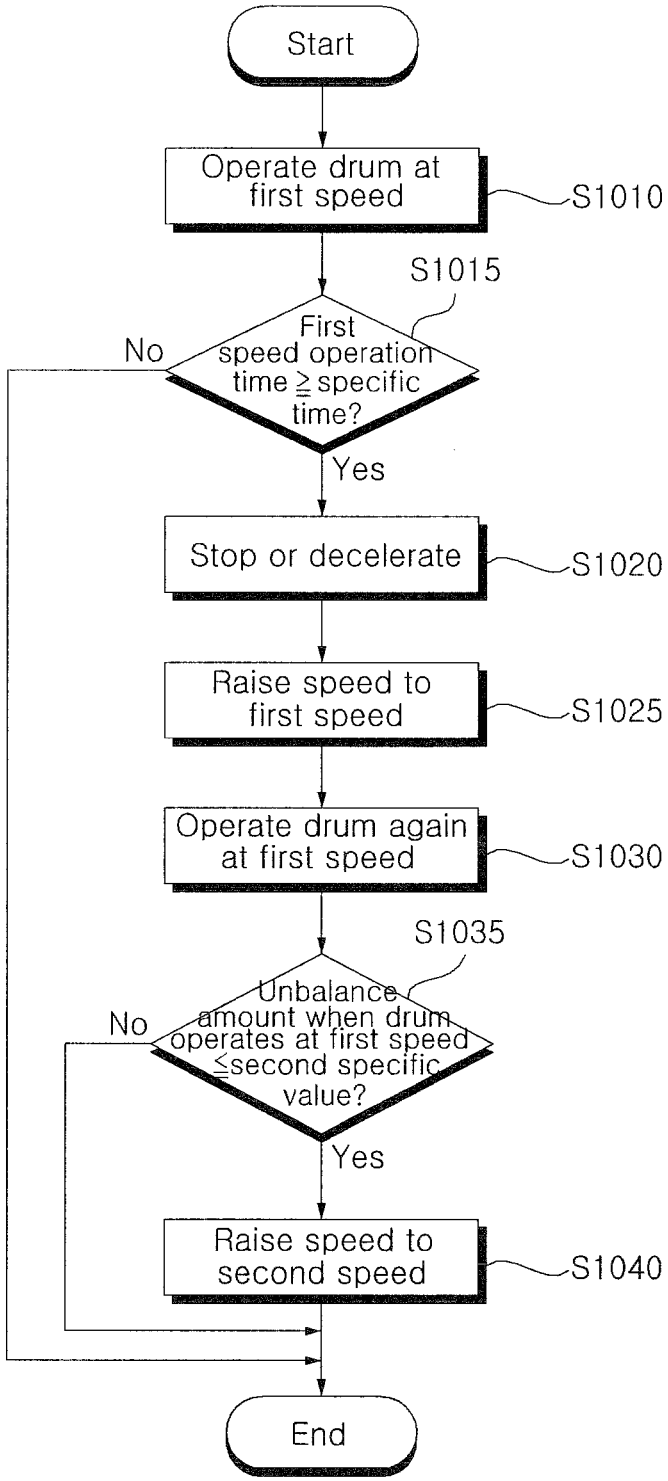
FIG. 10 is a flowchart illustrating a method of controlling a washing machine in accordance with an example embodiment of the present invention.

FIG. 10 is a flowchart illustrating a method of controlling a washing machine in accordance with an example embodiment of the present invention. Other operations, orders of operations and embodiments are also within the scope of the present invention.

The method of controlling the washing machine shown in FIG. 10 may be similar to the method shown in FIG. 9, but differs in that a determination is made whether a time during the first speed operation is abnormal.

The controller 210 may control the drum 122 to operate at the first speed V1 in operation S1010.

The controller 210 may then determine whether an operating time at the first speed V1 is a specific time or greater in operation S1015. If the operating time at the first speed V1 is determined to be the specific time or greater, the controller 210 may stop or decelerate the drum 122 in operation S1020.

Thereafter, an operation S1025 of increasing the speed of the drum 122 to the first speed, an operation S1030 of operating or rotating the drum again at the first speed, an operation S1035 of determining an unbalance amount during the first speed operation, and a second speed operation S1040 may be identical or similar to operations of FIG. 9.

Further, changing at least one of the first speed rising slope and the second speed rising slope when the drum 122 is operated or rotated again may also be similar or identical to FIG. 9.

When the drum 122 operates at the first speed, an operating time of the drum 122 may be determined, and when an abnormality occurs, rotation of the drum 122 may stop or decelerate immediately. Accordingly, stability of the washing machine and balancing of laundry can be ensured at the time of the dehydration cycle. Further, when the drum 122 operates again, at least one of the first speed rising slope and the second speed rising slope may change, thereby improving stability of the washing machine and balancing of laundry.

In order to distribute laundry accurately and rapidly, the drum 122 may be driven or rotated at the first speed V1 at which part of the laundry tumbles, which is not at a speed at which the entire laundry tumbles as in disadvantageous arrangements, thus meeting the balancing state of the laundry to some extent. The drum 122 may then operate at the second speed V2.

The method of controlling the washing machine may be implemented as a processor-readable code in a recording medium that can be read by a processor equipped in a washing machine. The processor-readable recording medium may include all kinds of recording devices in which data readable by a processor are stored. For example, the processor-readable recording medium may include ROM, RAM, CD-ROM, magnetic tapes, floppy disks, optical data storages, etc. and may also be implemented in a form of carrier waves, such as transmission over the Internet. Further, the processor-readable recording medium may be distributed into computer systems connected over a network, so codes readable by a processor can be stored and executed in a distributed manner.

According to the washing machine and the method of controlling the washing machine in accordance with embodiments of the present invention, when a drum operates at first speed, an unbalance amount or a first speed operation period of the drum may be determined, and when an abnormality occurs, the drum may stop or decelerate immediately. Accordingly, stability of the washing machine and balancing of laundry at a time of a dehydration cycle can be ensured.

Further, when the drum operates again, at least one of a first speed rising slope and a second speed rising slope may change. Accordingly, stability and balancing of laundry of a washing machine can be improved.

The drum may be driven or rotated at a first speed at which part of laundry tumbles, which is not a speed at which the entire laundry tumbles as in disadvantageous arrangements, thus meeting the balancing state of the laundry to some extent. The drum may then operate at a second speed. Accordingly, laundry can be distributed accurately and rapidly.

Embodiments of the present invention may provide a washing machine with improved stability and improved laundry balancing at a time of a dehydration cycle, and a method of controlling a washing machine.

An embodiment of the present invention may provide a method of controlling a washing machine including a drum in which laundry is entered and rotated, including operating the drum at a first speed at which a part of the laundry tumbles within the drum and another part of the laundry adheres to the drum. When an unbalance amount of the drum, which may be detected when the drum operates at the first speed, is a first specific value or greater, the drum may stop or rotation may be decelerated.

An embodiment of the present invention may provide a method of controlling a washing machine including a drum in which laundry is entered and rotated, including operating the drum at a first speed at which a part of the laundry tumbles within the drum and another part of the laundry adheres to the drum. When the first speed operation period is a specific time or greater, the drum may stop or rotation may be decelerated.

An embodiment of the present invention may provide a washing machine including a drum in which laundry is entered and rotated, an unbalance amount sensing unit for sensing an unbalance amount of the drum, and a controller for controlling the drum to operate at a first speed such that a part of the laundry tumbles within the drum and another part of the laundry adheres to the drum. When an unbalance amount of the drum, which is detected when the drum operates at the first speed, is a first specific value or greater, rotation of the drum may be controlled to stop or decelerate.

An embodiment of the present invention may provide a washing machine including a drum in which laundry is entered and rotated, and a controller for controlling the drum to operate at a first speed such that a part of the laundry tumbles within the drum and another part of the laundry adheres to the drum. When the first speed operation period is a specific time or greater, rotation of the drum may be controlled to stop or decelerate.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a washing machine that includes a drum configured to receive laundry therein, the method comprising:

initiating rotation of the drum and maintaining rotation of the drum substantially at a first speed such that a first part of the laundry received in the drum tumbles and a second part of the laundry received in the drum adheres to the drum and rotates with the drum, wherein the first speed corresponds to a speed that causes the second part of the laundry to adhere to the drum at a location where the second part of the laundry reaches a substantially uppermost point during rotation of the drum;

determining a first unbalance amount of the drum while the drum rotates at the first speed, wherein the first unbalance amount of the drum is determined based on a variation of a rotation speed of the drum caused by motion of the second part of the laundry during the rotation of the drum at the first speed;

decelerating rotation of the drum from the first speed to a second speed at which an amount of the laundry tumbling increase with respect to the first speed, in response to detection of the first unbalance amount being greater than or equal to a first specific value;

rotating the drum at the second speed;

thereafter rotating the drum at the first speed again, wherein initiating rotation of the drum and maintaining rotation of the drum at a first speed comprises increasing a rotation speed of the drum to the first speed at a first acceleration rate, and wherein rotating the drum at the first speed again after decelerating rotation of the drum comprises increasing the rotation speed of the drum back to the first speed at a second acceleration rate that is different from the first acceleration rate;

determining a second unbalance amount of the drum while the drum rotates at the first speed again, wherein the second unbalance amount of the drum is determined based on a variation of a rotation speed of the drum caused by motion of the second part of the laundry during the rotation of the drum at the first speed again;

increasing a rotation speed of the drum from the first speed to a third speed in response to the second unbalance amount being less than or equal to a second specific value so that both the first and second parts of the laundry received in the drum adhere to the drum and rotate with the drum; and operating the drum at the third speed.

2. The method of claim 1, wherein rotating the drum at the first speed again after decelerating rotation of the drum comprises operating the drum in a reverse direction after decelerating the rotation of the drum.

3. The method of claim 1, wherein increasing the rotation speed of the drum from the first speed to the third speed comprises increasing the rotation speed of the drum to the third speed at a third acceleration rate that is different from the second acceleration rate.

4. The method of claim 1, wherein the first speed is approximately 60 rpm.

5. The method of claim 1, wherein decelerating rotation of the drum from the first speed to the second speed comprises rotating the drum at a continuously decreasing speed, and rotating the drum at the second speed comprises maintaining rotation of the drum at the second speed for a first predetermined period of time.

6. The method of claim 5, wherein, after the first predetermined period of time has elapsed, the method further comprises continuously increasing a rotation speed of the drum until the drum reaches the first speed, and rotating the drum at the first speed for a second predetermined period of time.

7. The method of claim 6, wherein, after the second predetermined period of time has elapsed, the method further comprises continuously increasing a rotation speed of the drum until the drum reaches the third speed at which all of the laundry received in the drum adheres to the drum and rotates with the drum.

8. The method of claim 7, wherein continuously increasing a rotation speed of the drum until the drum reaches the first speed comprises continuously increasing the rotation speed of the drum at a first acceleration rate, and wherein continuously increasing a rotation speed of the drum until the drum reaches the third speed comprises continuously increasing the rotation speed of the drum at a second acceleration rate that is greater than the first acceleration rate.

* * * * *